US010388475B2

(12) United States Patent
Boettcher et al.

(10) Patent No.: US 10,388,475 B2
(45) Date of Patent: Aug. 20, 2019

(54) QUICKLY CLOSING SWITCH ELEMENT

(71) Applicant: Siemens Aktiengesellschaft, Munich (DE)

(72) Inventors: Martin Boettcher, Berlin (DE); Thomas Erlwein, Nuremberg (DE); Karsten Freundt, Falkensee (DE); Sarai Gonzalez, Duesseldorf (DE); Christian Heinrichs, Chemnitz (DE); Stefan Lecheler, Berlin (DE); Dorothea Pohlmann, Neu-Isenburg (DE); Werner Schmidt, Chemnitz (DE)

(73) Assignee: SIEMENS AKTIENGSELLSCHAFT, Munich (DE)

( * ) Notice: Subject to any disclaimer, the term of this patent is extended or adjusted under 35 U.S.C. 154(b) by 0 days.

(21) Appl. No.: 15/575,885

(22) PCT Filed: May 19, 2016

(86) PCT No.: PCT/EP2016/061285
§ 371 (c)(1),
(2) Date: Nov. 21, 2017

(87) PCT Pub. No.: WO2016/202521
PCT Pub. Date: Dec. 22, 2016

(65) Prior Publication Data

US 2018/0144890 A1 May 24, 2018

(30) Foreign Application Priority Data

Jun. 16, 2015 (DE) ..... 10 2015 211 030

(51) Int. Cl.

| | |
|---|---|
| ***H01H 31/32*** | (2006.01) |
| ***H01H 31/00*** | (2006.01) |
| ***H01H 33/68*** | (2006.01) |
| ***H01H 3/30*** | (2006.01) |

(52) U.S. Cl.
CPC ..... *H01H 31/003* (2013.01); *H01H 3/30* (2013.01); *H01H 31/32* (2013.01); *H01H 33/68* (2013.01); *H01H 2003/3089* (2013.01)

(58) Field of Classification Search
CPC ..... H01H 31/003; H01H 3/30; H01H 33/68; H01H 31/32; H01H 2003/3089
See application file for complete search history.

(56) References Cited

U.S. PATENT DOCUMENTS 3,156,800 A 11/1964 Date
3,761,651 A 9/1973 Fournier
(Continued)

FOREIGN PATENT DOCUMENTS

CN 1151600 A 6/1997
CN 201788021 U 3/2011
(Continued)

OTHER PUBLICATIONS

International Search Report PCT/ISA/210 for International Application No. PCT/EP2016/061285 dated Jul. 21, 2016.
(Continued)

*Primary Examiner* — Truc T Nguyen
(74) *Attorney, Agent, or Firm* — Harness, Dickey & Pierce, P.L.C.

(57) ABSTRACT

A switch, in particular a grounding switch, is for quickly establishing a ground connection and for extinguishing an arc fault for a switching system. The grounding switch includes at least one fixed contact having a first cable feed, a moving contact, a contact guide having a second cable feed, and a mechanical energy store. In the opened state, an insulating distance between the fixed contact and the moving contact, is filled with insulation liquid, at least in part. The switch further includes a triggering device and a locking mechanism.

18 Claims, 2 Drawing Sheets

(56) References Cited

U.S. PATENT DOCUMENTS

| | | | | |
|---|---|---|---|---|
| 5,206,616 | A * | 4/1993 | Stegmuller | H01H 33/666 218/136 |
| 5,521,567 | A * | 5/1996 | Devonald, III | H01H 33/022 335/132 |
| 6,242,708 | B1 * | 6/2001 | Marchand | H01H 33/6661 218/153 |
| 8,492,276 | B2 * | 7/2013 | Abe | C09K 3/1463 216/83 |
| 8,492,672 | B2 * | 7/2013 | Shea | H01H 39/004 218/118 |
| 2005/0224465 | A1 * | 10/2005 | Lammers | H02B 1/28 218/151 |
| 2010/0219162 | A1 | 9/2010 | Gentsch | |

FOREIGN PATENT DOCUMENTS

| | | | |
|---|---|---|---|
| DE | 1100780 | B | 3/1961 |
| DE | 2211463 | A1 | 9/1972 |
| DE | 10227748 | A1 | 4/2004 |
| EP | 2877530 | A2 | 12/2013 |
| JP | 2011040302 | A | 2/2011 |
| KR | 20060119681 | A | 11/2006 |
| RU | 124433 | U1 | 1/2013 |
| SU | 177949 | A1 | 1/1986 |
| SU | 1794262 | A3 | 2/1993 |
| WO | WO 2010022938 | A1 | 3/2010 |

OTHER PUBLICATIONS

Written Opinion of the International Searching Authority PCT/ISA/237 for International Application No. PCT/EP2016/061285 dated Jul. 21, 2016.

Korean Office Action and English translation thereof dated Jan. 11, 2019.

Chinese Office Action dated Nov. 2, 2018.

Russian Office Action dated Oct. 4, 2018.

* cited by examiner

QUICKLY CLOSING SWITCH ELEMENT

PRIORITY STATEMENT

This application is the national phase under 35 U.S.C. § 371 of PCT International Application No. PCT/EP2016/106128.5 which has an International filing date of May 19, 2016, which designated the United States of America and which claims priority to German patent application number 102015211030.3 filed Jun. 16, 2015, the entire contents of which are hereby incorporated herein by reference.

FIELD

An embodiment of invention generally relates to a quickly closing switching element, in particular a quickly closing grounding switch, in particular for use in low-voltage installations, medium-voltage installations or high-voltage installations.

BACKGROUND

US 20100219162 A1 discloses a switch that uses a chemical gas generator to move the movable contact of the switch.

A disadvantage when using chemical gas generators is the use of reactive propellants, which are subject to aging and consequently require corresponding regular maintenance.

A further disadvantage of chemical gas generators is that the driving force first has to be built up by the reaction of the chemical substances, that is to say the reactive propellants, before the movable contact can be accelerated.

To avoid a random unwanted disruptive discharge, and thus an unwanted short-circuit, US 2010219162 A1 and WO 10022938 A1 disclose the use of two separated vacuums, which in the case of switching both have to be bridged by the movable contact.

Disadvantageous in particular in this case is the costly dual configuration of the vacuum chamber and the associated long switching distances that the movable contact member has to cover, and consequently also longer switching times.

It is also disadvantageous that the vacuums connected in the case of switching cannot easily be separated again, and the switch used again, even if the chemical gas generator has been renewed.

SUMMARY

At least one embodiment of the invention provides an improved quickly switching switch which not only switches more quickly, or at least switches quickly, but also can be produced at low cost in comparison with the prior art, and also requires less maintenance than switches from the prior art, and also can be reused after a case of switching.

At least one embodiment of the invention is directed to a switch.

A switch according to at least one embodiment of the invention, in particular a grounding switch, for quickly establishing a ground connection, and consequently in particular for eliminating an arcing fault of contributing grounding switches for a switching installation, in particular a low-voltage installation or a medium-voltage installation or a high-voltage installation, comprises:

- a fixed contact with a first cable feed,
- a moving contact,

- a contact guide with a second cable feed,
- a mechanical energy store,
- in the opened state, an insulating clearance between the fixed contact and the moving contact, the insulating clearance being at least partially filled with insulating liquid, such as in particular insulating oil or insulating ester,
- a triggering device, and
- a locking mechanism.

BRIEF DESCRIPTION OF THE DRAWINGS

The subject matter of the invention is explained below on the basis of example embodiments and figures.

DETAILED DESCRIPTION OF THE EXAMPLE EMBODIMENTS

Figure 1:
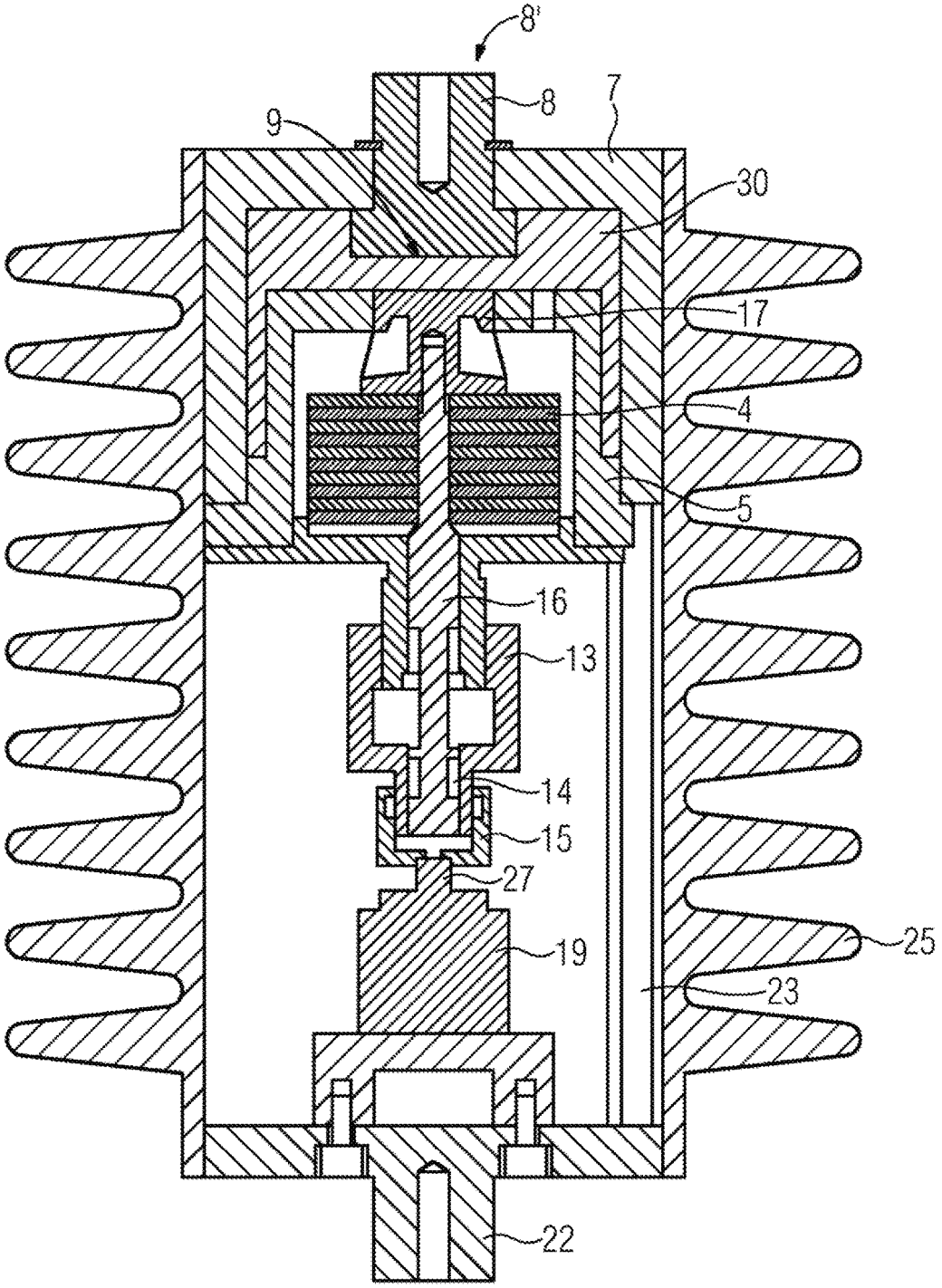
FIG. 1 shows a sectional view through a switch according to an embodiment of the invention, or grounding switch with magnetic triggering.

A switch according to at least one embodiment of the invention, in particular a grounding switch, for quickly establishing a ground connection, and consequently in particular for eliminating an arcing fault of contributing grounding switches for a switching installation, in particular a low-voltage installation or a medium-voltage installation or a high-voltage installation, comprises:

- a fixed contact with a first cable feed,
- a moving contact,
- a contact guide with a second cable feed,
- a mechanical energy store,
- in the opened state, an insulating clearance between the fixed contact and the moving contact, the insulating clearance being at least partially filled with insulating liquid, such as in particular insulating oil or insulating ester,
- a triggering device, and
- a locking mechanism.

In an example embodiment configuration, the locking mechanism has at least:

- an actuating element, such as a locking cage or a half-shaft,
- a locking device, such as a ball or latch, and
- a locking imparter or transmission element.

In another example embodiment

- the locking imparter can be connected to the moving contact,
- the mechanical energy store can be connected to the locking imparter,
- the locking imparter can be held by the locking cage via a locking device,
- the locking imparter can be released by the locking device from the locking cage via a triggering device,
- the moving contact can be accelerated by the mechanical energy store via the locking imparter, or by way of the locking imparter, in such a way that the moving contact can be brought into electrical contact with the fixed contact,
- the contact guide both serves for guiding the movement of the moving contact and serves for the contacting of the moving contact, and the insulating liquid can be displaced by the moving contact during the closing of the grounding switch.

In on embodiment, the insulating clearance may be completely filled with insulating liquid, the insulating liquid being displaced during the closing of the switch, that is to say in the case of switching, into a displacement volume that is not shown, preferably displaced into a displacement volume occurring behind the moved moving contact. Preferably, the displacement volume may be closed in the open state of the switch by a separating device, in particular by a flap or a valve or a bidirectional valve as the separating device. Only when the switch is triggered, that is to say the triggering device is triggered, is the separating device then opened and/or unlocked.

It is advantageous in the case of the solution according to at least one embodiment of the invention that the driving force is available from the moment of triggering, and as a result the moving contact is immediately accelerated with maximum force.

A further advantage of at least one embodiment is that the lifetime of a mechanical energy store, in particular a spring assembly, is greater than that of a gas generator, in particular greater than that of a chemical gas generator.

A further advantage of at least one embodiment is that special regulations with respect to the storage and handling of explosives are not necessary in either production or use.

A further advantage of at least one embodiment is that the entire function of the switch can be checked, since loading and unloading of the mechanical energy store, in particular tensioning and relaxing of the spring assembly, is possible and, by measuring for example the tensioning moment, there is in principle also a function of the drive. This allows easy quality control in production, and if appropriate also in or on the installed installation.

Testing of the electrical triggering circuit, in particular the magnetic coil or tensioning strip, is safely possible at any time.

It is also advantageous in at least one embodiment that, by contrast with a vacuum, there is no residual probability of random unwanted disruptive discharges in insulating liquids, in particular insulating oils or insulating esters.

In a preferred embodiment, after a case of switching and when there is renewed opening of the switch and/or tensioning of the mechanical energy store, that is to say generally when mechanical energy is being introduced into the mechanical store, the insulating liquid is transported out of the displacement volume again into the insulating clearance, and if appropriate the insulating clearance is separated again from the displacement volume, for example by a flap, and if appropriate the separating device between the insulating clearance and the displacement volume is locked again.

It is preferred, in at least one embodiment, that the locking imparter include a tension rod and a tensioning nut; that the locking device is formed by locking balls; that the mechanical energy store is realized by a spring assembly; and/or that the triggering device is formed by a triggering magnet.

In at least one embodiment, by way of the tensioning nut, energy can initially be fed to the mechanical energy store, or after a case of switching can again be fed to the mechanical energy store, in particular a spring assembly can be tensioned again. In this case, the moving contact can also be moved out of the closed switch position into the opened switch position.

If appropriate, when the tensioning nut is actuated, the insulating liquid is also transported from the displacement volume into the insulating clearance.

It is also preferred, in at least one embodiment, that the spring assembly in the relaxed state can be tensioned with the aid of the tensioning nut, and that the locking cage can be secured against triggering with respect to the tension rod by one or more screws.

It is also preferred, in at least one embodiment, that the locking imparter is formed by a control pin, the locking device is formed by a locking cage and by locking balls, the triggering device is formed by holding electrodes and a tensioning strip, and the mechanical energy store for triggering is realized by a control spring.

The triggering of the switch, in at least one embodiment, takes place by destroying the tensioning strip, in that an electrical control pulse burns through the tensioning strip.

The electrical control pulse is in this case generated between the holding electrodes.

In a preferred configuration, in at least one embodiment, the tensioning strip is produced from carbon fibers, since they can carry a high tensile stress and can be designed to be appropriately thin. In addition, the carbon fiber has a comparatively high resistivity and a low mass, so that less energy is required for burning through.

It is also preferred, in at least one embodiment, that the actuating element is formed by a half-shaft and the locking device is a latch.

It is likewise preferred, in at least one embodiment, that the contact guide is designed in such a way that it is only in a final phase of a closing operation of the grounding switch, that is to say shortly before the moving contact comes up against the fixed contact, that the moving contact produces mechanical contact over a large area between the moving contact and the fixed contact, leading to a deceleration of the movement of the moving contact and bringing about an electrical contact between the contact guide and the moving contact.

It is also preferred, in at least one embodiment, that the contact guide and/or the moving contact and/or the fixed contact has in at least one region a retarding layer, in which the moving contact can be brought into contact with the contact guide and/or the fixed contact, the retarding layer consisting of electrically conducting material and being designed in such a way that the speed of the moving contact is reduced by coming up against the retarding layer.

It is also preferred, in at least one embodiment, that the fixed contact has a retarding layer in the contact region with the moving contact, so that the movable contact member striking the fixed contact at high speed is additionally decelerated by deformation of the electrically conducting retarding layer.

It is also preferred, in at least one embodiment, that the retarding layer is plastically deformable by comprising expanded metal or a suitably structured surface.

It is likewise preferred, in at least one embodiment, that the moving contact coming up against the retarding layer, and/or the fixed contact coming up against the retarding layer, and/or the contact guide coming up against the retarding layer, has the effect that the retarding layer at least partially melts, and thus solders or can solder the fixed contact and/or the moving contact and/or the contact guide with the fixed contact and/or the moving contact and/or the contact guide.

It is also preferred, in at least one embodiment, that, in the closed switching state, the main current flows from the fixed contact by way of the retarding layer, the moving contact and the contact guide to a second cable feed, consisting of a current bridge and a stationary ground contact.

It is also preferred, in at least one embodiment, that in the moving contact and/or fixed contact there are bores or channels that allow the insulating liquid to leave the closing intermediate space between the moving contact and the fixed contact even when the edges of the moving contact and the fixed contact are already touching. In particular if the moving contact and the fixed contact are formed as inter-engaging or partially inter-engaging conical surfaces.

In FIG. 1 there is shown a quick grounding switch 1, the triggering mechanism comprising a magnetic triggering. In this case, a triggering magnet 19 is used as the triggering device 19. The control pin 27 of the triggering magnet 19 acts on the locking cage 15. The tension rod 16 is held in the locking cage 15 by locking balls 14. At its other end, the tension rod 16 is connected to the spring assembly 4 and the moving contact 17. In the opened switching state, between the fixed contact 8 and the moving contact 17 there is an insulating clearance. This insulating clearance is filled with an insulating liquid, in particular insulating oil or insulating ester 30.

Also shown in FIG. 1 is an advantageous configuration of the fixed contact 8, in which the fixed contact 8 has a retarding layer 9 on its contact area.

Furthermore, the special grounding switch 1 has an insulating housing 7 and an outer housing 25, which may also be configured as one part.

The moving contact 17 is guided over at least part of the contact gap by a contact guide 5. This contact guide 5 also serves for the electrical contacting of the moving contact 17 in the closed position of the switch. The contact guide 5 is electrically connected to the ground contact 22 by way of a current bridge 23. The ground contact 22 is also referred to as the second feed line 22. The fixed contact 8 can be contacted by way of a first feed line 8'.

For tensioning the spring assembly 4, a tensioning nut 13 is provided.

Figure 2:
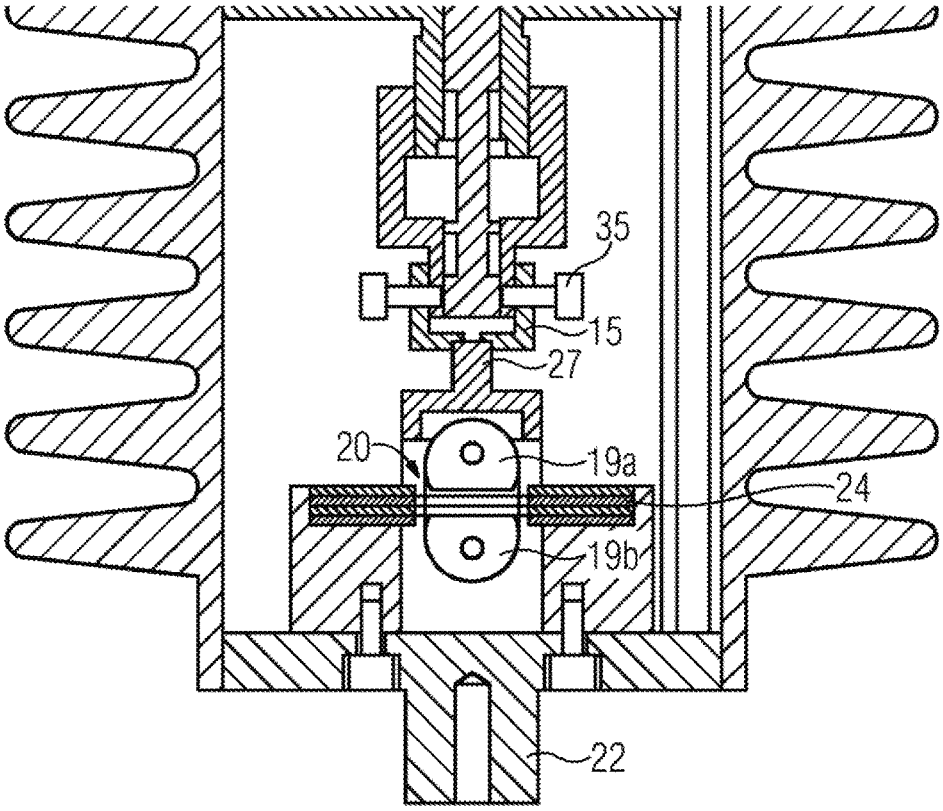
FIG. 2 shows a sectional view through a switch according to an embodiment of the invention, or grounding switch with thermal triggering, only the triggering mechanism being shown.

FIG. 2 shows a detail of a grounding switch according to an embodiment of the invention, a thermal triggering being realized here as an alternative solution. The thermal triggering for the control spring 24 is by a tensioning strip 20, which is fastened to the holding electrodes 19*a*, 19*b* or is tensioned by way of these holding electrodes 19*a*, 19*b* in such a way that the control spring 24 is kept in the tensioned position. In the case of triggering, the control spring 24 actuates the control pin 27, which moves the locking cage 15 in such a way that the moving contact is triggered and is accelerated in the direction of the fixed contact by the control spring 24.

The tensioning strip 20 can be thermally destroyed, and a switch thus triggered, by way of an electrical pulse that is generated between the holding electrodes 19*a*, 19*b*.

The screws 35 serve for fixing the tension rod during maintenance work or during the tensioning of the control spring 24.

Figure 3:
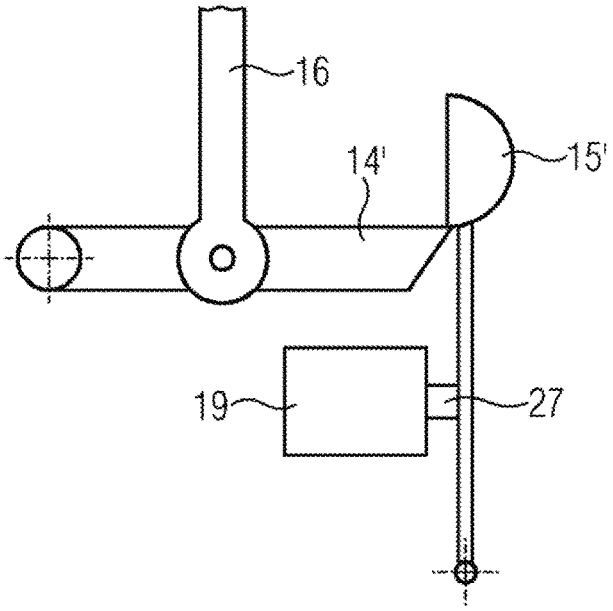
FIG. 3 shows an alternative triggering mechanism.

FIG. 3 shows an alternative triggering mechanism. Serving in this case as the triggering device 19 is an electromagnet, which can act with a control pin 27 on the movable, in particular rotatable, mounting of a half-shaft 15' in such a way that the latch 14' is released. When the latch 14' is released from the half-shaft 15', the spring assembly 4 (not shown in FIG. 3), which is connected to the latch 14' by way of the tension rod 16, brings about an acceleration of the moving contact 17 toward the fixed contact 8; the moving contact and the fixed contact are not shown in FIG. 3.

The invention claimed is:

1. A switch for quickly establishing a ground connection for a switching installation, the switch comprising:

a fixed contact including a first cable feed;

a moving contact;

a contact guide including a second cable feed, wherein in an opened state, an insulating clearance exists between the fixed contact and the moving contact, the insulating clearance being at least partially filled with insulating liquid;

a mechanical energy store;

a triggering device; and a locking mechanism, including at least a locking cage, a locking device, and a locking imparter, the locking imparter being connectable to the moving contact and the mechanical energy store being connectable to the locking imparter, and wherein:

the locking imparter is configured to be held in the locking cage via the locking device, and is releasable by the locking device from the locking cage, via the triggering device, the moving contact is configured to be accelerated by the mechanical energy store, via the locking imparter, such that the moving contact is configured to be brought into electrical contact with the fixed contact, the contact guide is configured to guide movement of the moving contact and contact the moving contact, the insulating liquid is displaceable by the moving contact during the closing of the grounding switch the locking imparter includes a tension rod and a tensioning nut, the locking device is formed by locking balls, the mechanical energy store is realized by a spring assembly, and the triggering device is formed by a triggering magnet.

2. The grounding switch of claim 1, wherein the spring assembly, in a relaxed state, is configured to be tensioned via the tensioning nut, and wherein the locking cage is configured to be secured against triggering, with respect to the tension rod, by screws.

3. The switch of claim 1, wherein the contact guide is designed such that the contact guide is only in a final phase of a closing operation of the grounding switch, shortly before the moving contact comes up against the fixed contact, that the moving contact produces mechanical contact over a large area between the moving contact and the fixed contact, leading to a deceleration of the movement of the moving contact and bringing about an electrical contact between the contact guide and the moving contact.

4. The switch of claim 1, wherein at least one of the contact guide, the moving contact and the fixed contact includes, in at least one region, a retarding layer in which the moving contact is configured to be brought into contact with at least one of the contact guide and the fixed contact, the retarding layer consisting of electrically conducting material and being designed such that a speed of the moving contact is reduced by coming up against the retarding layer.

5. The switch of claim 1, wherein, in a closed switching state, the main current flows from the fixed contact by way of a retarding layer, the moving contact and the contact guide to a second cable feed, consisting of a current bridge and a stationary ground contact.

6. The switch of claim 1, wherein the switch is a grounding switch.

7. The switch of claim 1, wherein the switch is for quickly establishing a ground connection and for eliminating an arcing fault.

8. The switch of claim 4, wherein the fixed contact includes a retarding layer in the contact region with the moving contact, so that the movable contact member striking the fixed contact at a relatively high speed is additionally decelerated by deformation of the electrically conducting retarding layer.

9. The switch of claim 4, wherein the retarding layer is plastically deformable by comprising expanded metal or a suitably structured surface.

10. The switch of claim 4, wherein at least one of the moving contact coming up against the retarding layer, the fixed contact coming up against the retarding layer, and the contact guide coming up against the retarding layer, has an effect wherein the retarding layer at least partially melts, and thus solders at least one of the fixed contact, the moving contact and the contact guide with at least one of the fixed contact, the moving contact and the contact guide.

11. The switch of claim 8, wherein the retarding layer is plastically deformable by comprising expanded metal or a suitably structured surface.

12. A switch for quickly establishing a ground connection for a switching installation, the switch comprising:

a fixed contact including a first cable feed;

a moving contact;

a contact guide including a second cable feed, wherein in an opened state, an insulating clearance exists between the fixed contact and the moving contact, the insulating clearance being at least partially filled with insulating liquid;

a mechanical energy store;

a triggering device; and a locking mechanism, the locking mechanism including at least a locking cage, a locking device, and a locking imparter, and wherein the locking imparter is formed by a control pin, the locking device is formed by locking balls and a tensioning strip, the triggering device is formed by holding electrodes, and the mechanical energy store is realized by a control spring.

13. The switch of claim 12, wherein the contact guide is designed such that the contact guide is only in a final phase of a closing operation of the grounding switch, shortly before the moving contact comes up against the fixed contact, that the moving contact produces mechanical contact over a large area between the moving contact and the fixed contact, leading to a deceleration of the movement of the moving contact and bringing about an electrical contact between the contact guide and the moving contact.

14. The switch of claim 12, wherein at least one of the contact guide, the moving contact and the fixed contact includes, in at least one region, a retarding layer in which the moving contact is configured to be brought into contact with at least one of the contact guide and the fixed contact, the retarding layer consisting of electrically conducting material and being designed such that a speed of the moving contact is reduced by coming up against the retarding layer.

15. The switch of claim 12, wherein, in a closed switching state, the main current flows from the fixed contact by way of the retarding layer, the moving contact and the contact guide to a second cable feed, consisting of a current bridge and a stationary ground contact.

16. The switch of claim 14, wherein the fixed contact includes a retarding layer in the contact region with the moving contact, so that the movable contact member striking the fixed contact at a relatively high speed is additionally decelerated by deformation of the electrically conducting retarding layer.

17. The switch of claim 14, wherein the retarding layer is plastically deformable by comprising expanded metal or a suitably structured surface.

18. The switch of claim 14, wherein at least one of the moving contact coming up against the retarding layer, the fixed contact coming up against the retarding layer, and the contact guide coming up against the retarding layer, has an effect wherein the retarding layer at least partially melts, and thus solders at least one of the fixed contact, the moving contact and the contact guide with at least one of the fixed contact, the moving contact and the contact guide.

* * * * *